US007131710B2

(12) United States Patent
Richardson

(10) Patent No.: US 7,131,710 B2
(45) Date of Patent: Nov. 7, 2006

(54) MAIN DOOR LOCK HOUSING FOR A VENDING MACHINE

(75) Inventor: Edmund Scott Richardson, Simpsonville, SC (US)

(73) Assignee: Maytag Corporation, Newton, IA (US)

( * ) Notice: Subject to any disclaimer, the term of this patent is extended or adjusted under 35 U.S.C. 154(b) by 430 days.

(21) Appl. No.: 10/678,277

(22) Filed: Oct. 6, 2003

(65) Prior Publication Data

US 2004/0108794 A1 Jun. 10, 2004

Related U.S. Application Data

(60) Provisional application No. 60/415,770, filed on Oct. 4, 2002.

(51) Int. Cl.
*E05B 65/06* (2006.01)

(52) U.S. Cl. ..... 312/215

(58) Field of Classification Search ..... 312/36, 312/42, 45, 72, 109, 138.1, 215; 70/208, 70/209; 292/199; 109/53–57, 66–68; 221/154; 49/15

See application file for complete search history.

(56) References Cited

U.S. PATENT DOCUMENTS 3,550,412 A * 12/1970 Silverman et al. ..... 70/461
4,823,579 A 4/1989 Castricum
5,193,862 A * 3/1993 Oden ..... 292/50
6,050,448 A 4/2000 Willis
6,735,989 B1 * 5/2004 Schramm et al. ..... 70/2
2002/0083747 A1 7/2002 Beylotte et al.

* cited by examiner

*Primary Examiner*—James O. Hansen
(74) *Attorney, Agent, or Firm*—Diederiks & Whitelaw PLC

(57) ABSTRACT

A vending machine includes a cabinet frame having top, bottom, side and rear walls that collectively define a central cavity. A plurality of column walls are arranged within the central cavity that, together with the side walls, form an associated plurality of stack or column areas for receiving product containers to be vended. The vending machine includes a door that is pivotally mounted to the cabinet frame for selectively closing off the central cavity. In order to prevent unauthorized access to the product stored in the central cavity, the vending machine is provided with a lock assembly including a main body and a lock member. The main body includes first and second fixed end portions and an intermediate portion that spans one of the plurality of stack areas. The lock member is attached to the main body and receives a locking element of the door.

28 Claims, 5 Drawing Sheets

MAIN DOOR LOCK HOUSING FOR A VENDING MACHINE

CROSS-REFERENCE TO RELATED APPLICATION

The present application claims benefit to U.S. Provisional Patent Application Ser. No. 60/415,770 entitled "MAIN DOOR LOCK HOUSING FOR A VENDING MACHINE" filed on Oct. 4, 2002.

BACKGROUND OF THE INVENTION

1. Field of the Invention

The present invention pertains to the art of vending machines and, more particularly, to a lock housing for a vending machine having first and second ends, each of which is secured to an internal structural member of the vending machine.

2. Discussion of the Prior Art

In general, it is known to secure a main door of a vending machine with a lock having a fixed lock housing. Typically, the lock housing is secured to a structural member of the vending machine. With this arrangement, unauthorized access to commodities stored within the machine is prevented, thus reducing the occurrence of pilfering and the like.

There are a wide variety of lock arrangements currently in use. Manufactures employ barrel locks and pad-locks to secure the commodities contained within the vending machine. Still other mechanisms include a barrel lock in combination with a spinner and threaded rod assembly. In accordance with this arrangement, release of the barrel lock enables the spinner to rotate a threaded rod. The threaded rod passes from the spinner through the main door and engages a lock housing secured to internal structure of the vending machine. More specifically, the lock housing includes an associated threaded bore adapted to engage the threaded rod. Once the threaded rod is clear of the bore, the main door is free to open thereby providing access to internal machine areas.

Typically, the lock housing is cantilevered from a wall or other structural member of the machine. As such, forces applied to the lock housing are only supported at one end. Accordingly, extreme loading of the door may cause the lock housing to fail, and thus enable unauthorized access to the commodities stored within the machine. In the event that the lock housing does not fail on a first attempt, high loads applied to the cantilevered housing will create structural defects in the housing material.

Despite the known locking mechanisms, there exists a need for a vending machine lock having a lock housing secured to structural components of the vending machine. More specifically, there exists a need for a lock housing having first and second ends, each of which is independently secured to the vending machine such that stress associated with excessive loading of the main door is distributed throughout the lock housing and not focused at a particular point along the housing.

SUMMARY OF THE INVENTION

The present invention is directed to a lock housing for a vending machine. More specifically, the lock housing includes a main body portion having a first end extending to a second end through an intermediate portion. Preferably, the intermediate portion is formed from a steel plate having first and second longitudinally extending bend portions that form a central channel. More preferably, each of the first and second bend portions define opposing side walls. A central bore is located centrally of the intermediate portion which provides access to the central channel through the intermediate portion. In addition, a second bore, located adjacent to the central bore extends thought the intermediate portion.

With this arrangement, a floating lock element having first and second threaded bores is secured in the central channel. More specifically, the central bore of the floating lock is located in a manner such as to correspond to the central bore arranged on the intermediate portion. The second threaded bore is arranged to correspond to the second bore on the intermediate portion such that a mechanical fastener, extending through the intermediate portion secures the floating lock element in the central channel.

In accordance with one form of the invention, each of the first and second ends constitute axial bend sections which include out-turned elements that form attachment flanges. The first end of the lock housing includes an out-turned flange formed substantially parallel to the main body portion. The out-turned flange is provided with a bore through which a mechanical fastener can secure the first end of the lock housing to a structural member of the vending machine. The second end of the lock housing is defined by a bend section formed perpendicular to the main body portion and is provided with first and second mounting ears. Each of the first and second mounting ears include respective openings through which a mechanical fastener can secure the second end of the lock housing to a structural member of the vending machine. Preferably, the lock housing is secured between two respective column walls arranged opposite a hinge element. More preferably, the lock housing spans a stack area defined by the opposing column walls. In accordance with the invention the structural stability of the second end is improved though the incorporation of first and second slotted openings arranged on the bend second section. The slotted openings are adapted to engage respective tab portions formed on an end portion of the side wall adjacent to the second end. With this arrangement, force exerted on the second end is distributed more evenly over the entire lock housing.

In accordance with another form of the present invention, the first end extends to a first in-turned segment. Specifically, the first in-turned segment leads to an angled portion which terminates in a down-turned tab segment. With this arrangement the first end of the lock housing is secured to a side portion of a bottle retaining column located remote from a hinge element of the main door. More specifically, the side portion of the bottle retaining column includes a slot adapted to receive the down-turned tab segment of the first end. Therefore, in accordance with this embodiment, the need for additional mechanical fasteners is eliminated without sacrificing the structural integrity of the lock housing.

Additional objects, features and advantages of the present invention will become more readily apparent to one of ordinary skill in the art from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
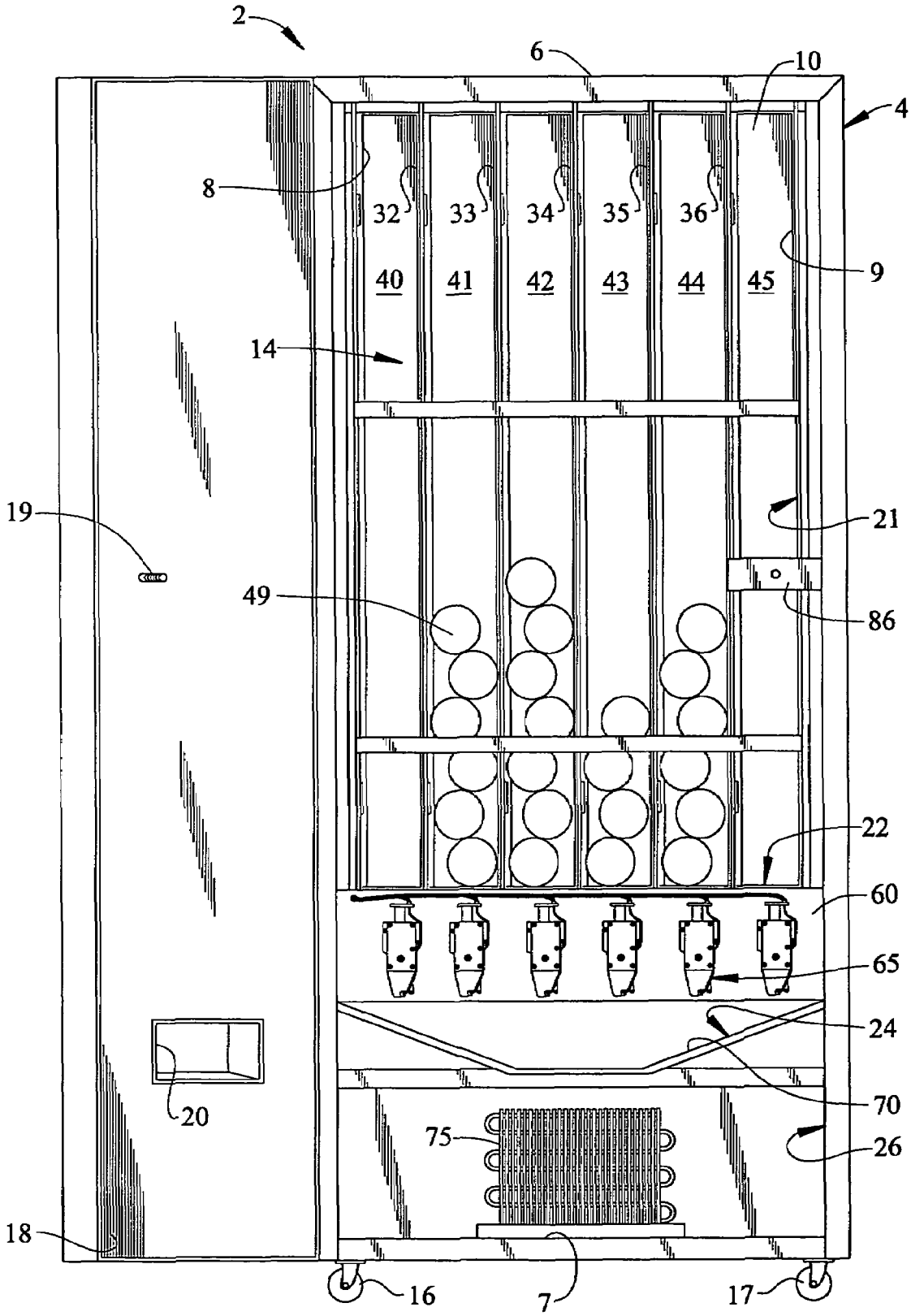
FIG. 1 is a plan view of a vending machine showing a main door in an open position exposing internal structure of the machine including a main door lock housing constructed in accordance with the present invention.

With initial reference to FIG. 1, a vending machine 2 includes a cabinet frame 4 having top, bottom, side and rear walls 6–10 that collectively define a central cavity 14. In a manner known in the art, a first pair of wheels or casters 16 and 17 are secured to a front edge portion of bottom wall 7 to facilitate the positioning of vending machine 2. Of course it should be realized that a second pair of wheels (not shown) are also arranged on a rear portion of bottom wall 7. A door 18 is pivotally mounted to cabinet frame 4 to selectively enable access to central cavity 14 in order to load various product containers or other commodities into vending machine 2. Door 18 is provided with a locking mechanism, shown in the form of a threaded rod 19, to retain door 18 in a closed position so as to prevent pilfering of the commodities from central cavity 14. Door 18 is also provided with an opening 20 to enable a consumer to remove a vended product container or other commodity from vending machine 2.

Central cavity 14 includes a storage section 21, a dispensing section 22, a delivery section 24 and a lower section 26. Storage section 21 is provided to hold products in escrow until a vending operation is performed. Towards that end, storage section 21 is provided with a plurality of vertically extending column walls 32–36 which, together with side walls 8 and 9, form a plurality of column or stack areas 40–45. In the embodiment shown in FIG. 1, stack areas 40–45 constitute single stack columns. However, it should be understood that the present invention also encompasses vending machines having multi-stack columns. In any event, stack areas 40–45 are partitioned by walls 32–36 to contain, separate and support a plurality of generally cylindrical containers 49 which, in the embodiment shown, constitute soda cans.

As further shown in FIG. 1, dispensing section 22 is provided with a frontal support wall 60 having arranged thereon a plurality of vend motors, one of which is indicated at 65. As will be discussed more fully below, a plurality of cradles (not shown) are arranged behind frontal support wall 60. Actually, each column or stack area 40–45 is provided with an associated cradle (not shown) that is operated through a respective one of the plurality of vend motors 65. Upon selection of a particular product container 49 or other commodity, one of the plurality of vend motors 65 is activated to rotate a respective cradle causing a product container 49, corresponding to the selected product, to emerge from vending machine 2. That is, product container 49 is transported to a product delivery chute 70 provided in delivery section 24 which is exposed to opening 20 in door 18. In order to maintain containers 49 in a refrigerated state, lower section 26 is provided with a cooling system 75. In general, the above description is provided for the sake of completeness and to enable a better understanding of the invention. The present invention is actually directed to the incorporation of a main lock housing for securing door 18 across central cavity 14.

Figure 2:
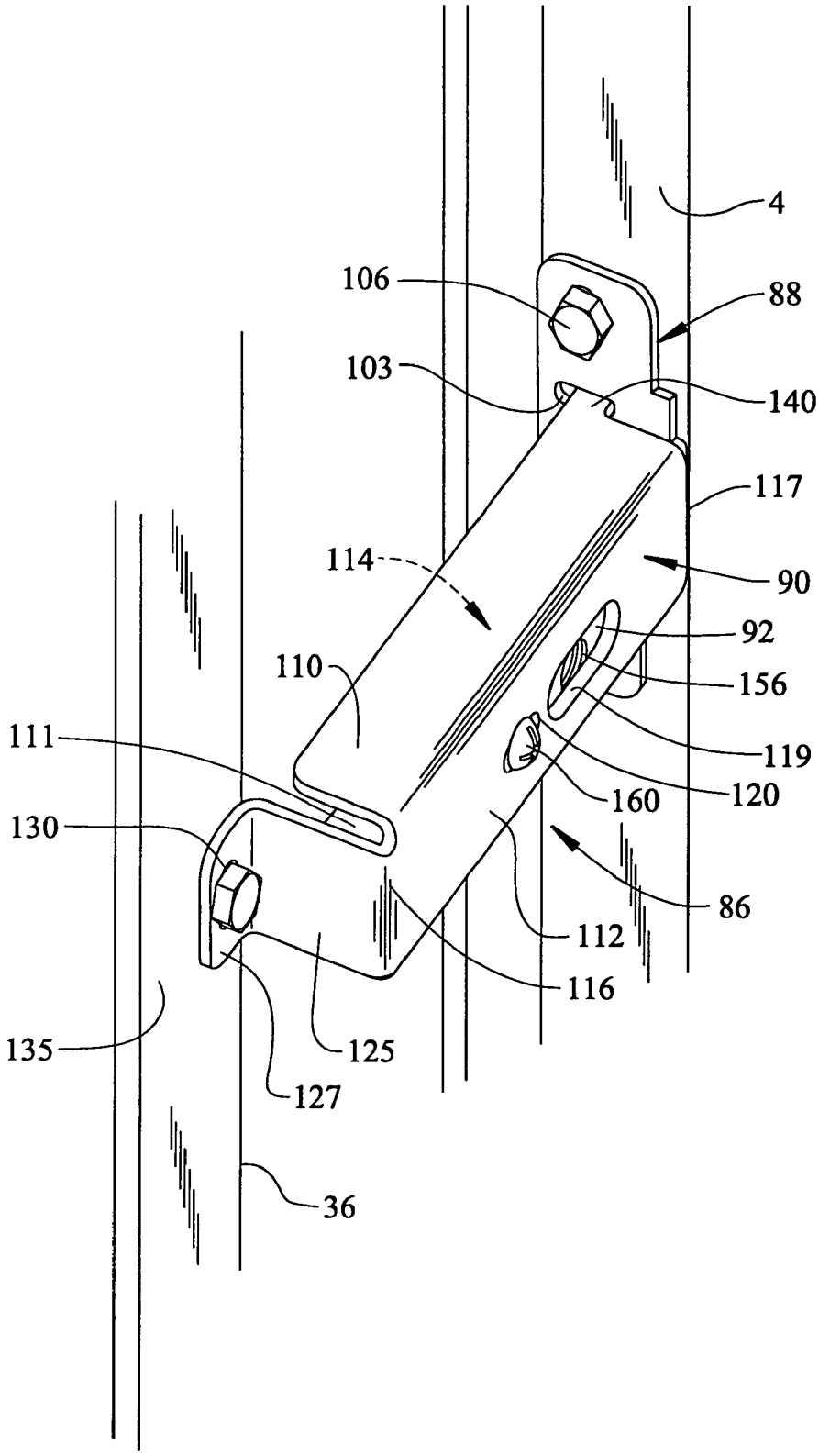
FIG. 2 is an upper perspective view of the main door lock housing constructed in accordance with a first embodiment of the present invention.
Figure 3:
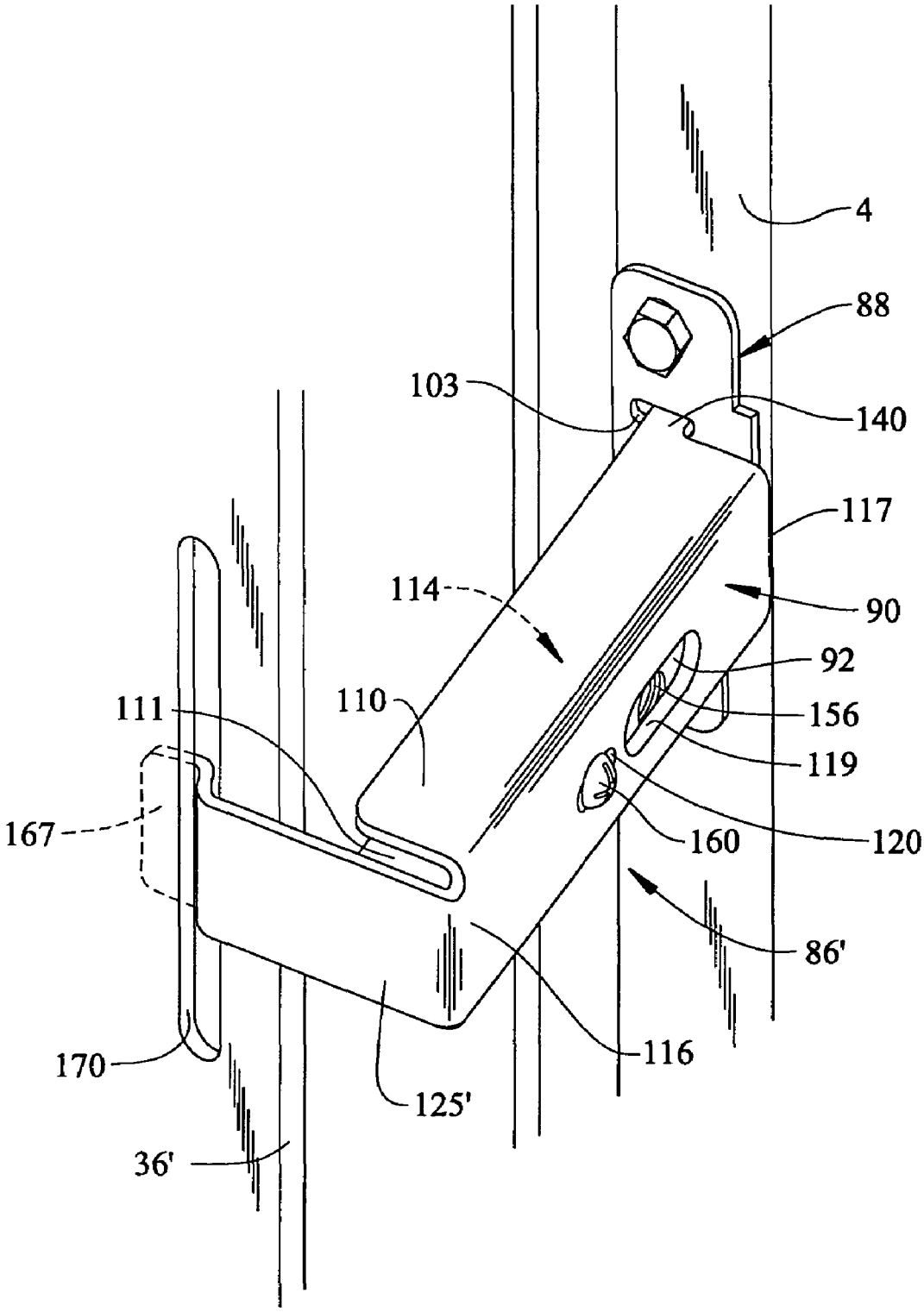
FIG. 3 is an upper perspective view of the main door lock housing constructed in accordance with a second embodiment of the present invention.
Figure 4:
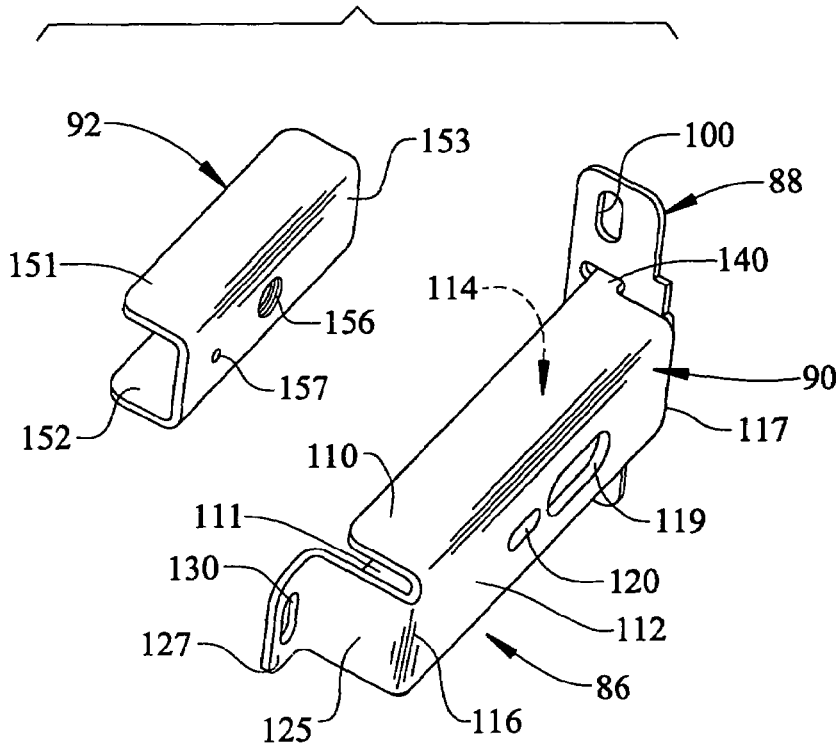
FIG. 4 is an exploded view of the main door lock housing of FIG. 2.
Figure 5:
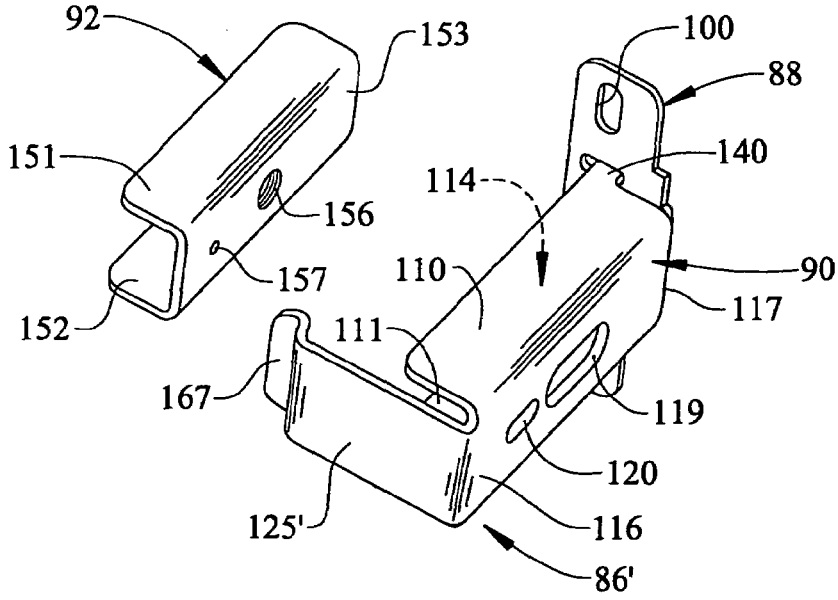
FIG. 5 is an exploded view of the main door lock housing of FIG. 3.
Figure 6:
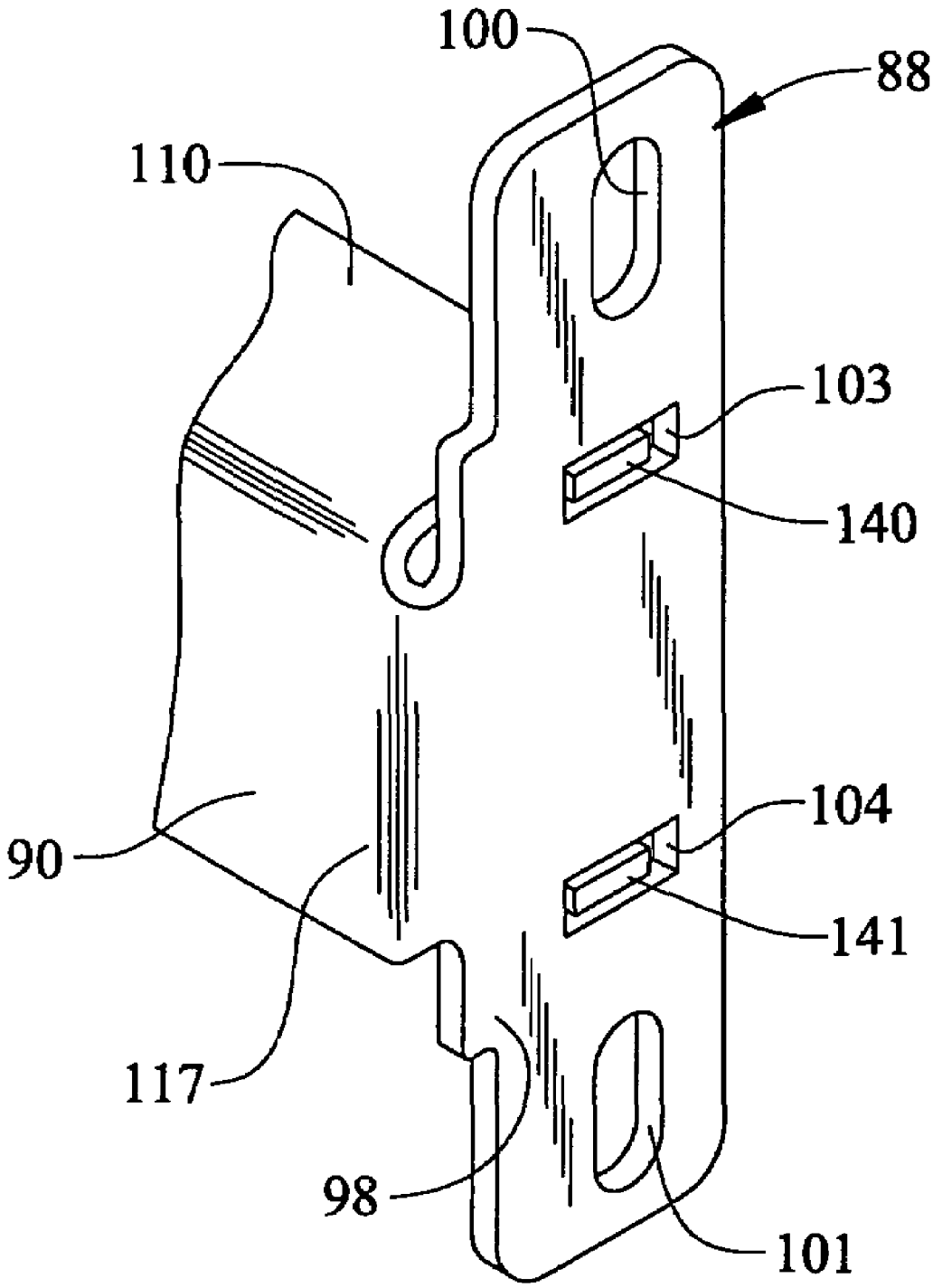
FIG. 6 is a partial perspective view of an end portion of the main door lock housing constructed in accordance with either the first or second embodiment of the present invention.

Referring to FIGS. 2–6, a lock housing assembly 86 constructed in accordance with a first embodiment of the invention includes a support flange or bracket 88, a main body portion 90 and a lock member 92 which, in the most preferred form of the invention, is constituted by a floating lock element. As best shown in FIG. 6, support bracket 88 includes a planar surface 98 having arranged therein first and second mounting apertures 100 and 101, as well as a pair of slotted openings 103 and 104 positioned inwardly of mounting apertures 100 and 101. Mounting apertures 100 and 101 enable support bracket 88 to be secured to cabinet frame 4 through mechanical fasteners 106. With particular reference to FIGS. 2, 4 and 6, main body portion 90 has a generally U-shaped cross section including first and second side walls 110 and 111 that are interconnected through an intermediate wall 112. More specifically, first and second side walls 110 and 111 and intermediate wall 112 collectively define a rear channel or cavity 114 which, as will be discussed more fully below, accommodates lock member 92. In any event, main body portion 90 includes first and second end portions 116 and 117 that are separated by intermediate wall 112. In the most preferred form of the invention, intermediate wall 112 is provided with first and second openings 119 and 120.

First end portion 116 includes an attachment flange 125. As shown, attachment flange 125 extends generally perpendicularly from first end portion 116 of intermediate wall 112 and terminates in a mounting element or leg 127. Mounting element 127 actually projects substantially perpendicularly outward from attachment flange 125 and is provided with an opening or mounting aperture 130 used in securing mounting element 127 to a front face portion 135 of column wall 36. On the other hand, second end portion 117 is provided with first and second interlocking tab elements 140 and 141. Interlocking tab elements 140 and 141 extend into slotted openings 103 and 104 of support bracket 88 so as to provide additional structural support for lock housing assembly 86. Actually, in the most preferred form of the present invention, support flange 88, main body portion 90 and attachment flange 125 are formed from bending a single steel plate in order to provide increased structural integrity for lock housing assembly 86.

As best illustrated in FIG. 4, floating lock member 92 has a generally U-shaped cross-section including first and second side walls 151 and 152 that are interconnected through a central wall 153. Central wall 153 is provided with first and second threaded openings 156 and 157 which align with openings 119 and 120 in intermediate wall 112. With this construction, lock member 92 can be inserted into channel 114 so that threaded openings 156 and 157 are positioned substantially adjacent to, i.e., directly behind, openings 119 and 120 respectively. Lock member 92 is then secured to main body portion 90 by inserting a mechanical fastener 160 through opening 120 and into threaded opening 157. Preferably, mechanical fastener 160 is engaged into lock member 92 in such a manner as to allow lock member 92 to float or move somewhat freely within main body portion 90 which, as will be discussed more fully below, facilitates the locking of vending machine 2.

Reference will now be made to FIGS. 3 and 5 in describing a second embodiment of the present invention. In some vending machine arrangements, the column walls have a thin profile and are typically not provided with a front face portion that corresponds to face portion 135. To address this fact, a lock housing assembly 86' constructed in accordance with this embodiment of the invention includes a modified attachment flange 125'. More specifically, attachment flange 125' is provided with an in-turned tab member 167 adapted to engage or hook into a slotted opening 170 provided on a side surface (not labeled) of column wall 36'. In this manner, main housing 90 can be fully supported at both first and second end portions 116 and 117 across stack area 45 despite the lack of a front face portion on column wall 36'.

Regardless of the particular arrangement, each of lock housing assemblies 86 and 86' provides a uniquely strong base to which door 18 can be secured. For instance, as main body portion 90 spans stack area 45 and is supported at both ends 116 and 117, little if any moment arm is present that would potentially limit the structural integrity of lock housing 86. More specifically, any prying force that is applied to door 18 would be distributed across main body portion 90 in its entirety, thereby decreasing the likelihood of forced entry into vending machine 2. After loading product containers 49 into storage section 21, a technician closes door 18 to position threaded rod 19 at opening 119 on main body portion 90. Threaded rod 19 engages with the threads provided in threaded opening 156 of lock member 92. Threaded rod 19 is rotated into engagement with lock member 92 and seated against door 18. Thereafter, a barrel lock or the like (not shown) is engaged so as to prevent unauthorized access to central cavity 14.

Although described with reference to preferred embodiments of the present invention, it should be readily apparent to one of ordinary skill in the art that various changes and/or modifications can be made to the invention without departing from the spirit thereof. For instance, the overall shape of the lock assembly can be varied depending upon the particular vending machine. In addition, while described as being stamped or otherwise formed from a single piece of steel, it should be recognized that the lock housing assembly could be formed from a plurality of pieces joined together, such as through a welding process. In general, the invention is only intended to be limited to the scope of the following claims.

I claim:

1. A vending machine comprising:

a cabinet frame including top, bottom, side and rear walls that collectively define a central cavity;

a plurality of column walls defining various stack areas for receiving product containers to be dispensed from the vending machine;

a door pivotally connected to the cabinet frame, said door being selectively movable between an open condition, wherein access to the central cavity is permitted for loading of product containers into the various stack areas of the vending machine, and a closed condition, wherein dispensing of product containers is permitted;

a locking element attached to the door; and a lock assembly including a main body and a lock member, said main body having a first end portion secured to the cabinet frame, a second end portion attached to one of the plurality of column walls, and an intermediate portion extending between the first and second end portions, with said intermediate portion being provided with a first opening, said lock member being interconnected to the main body and including a second opening which is aligned with the first opening, wherein the locking element on the door extends into each of the first and second openings and engages the lock member to secure the door in the closed condition so as to prevent pilfering of the vending machine.

2. The vending machine according to claim 1, wherein the lock assembly further includes a support bracket interconnecting the first end portion of the main body to the cabinet frame.

3. The vending machine according to claim 2, wherein the support bracket is detachably secured to the cabinet frame through a plurality of mechanical fasteners.

4. The vending machine according to claim 2, wherein support bracket is integrally formed with the main body.

5. The vending machine according to claim 4, wherein the support bracket is formed with at least one slot and said main body includes at least one tab element which extends into the at least one slot to interlock the support bracket and the main body.

6. The vending machine according to claim 5, wherein the support bracket is formed with at least two slots and said main body includes at least two tab elements interlocking the main body with the support bracket through the at least two slots.

7. The vending machine according to claim 1, wherein the main body is generally U-shaped in cross-section having first and second side walls interconnected by an intermediate wall, said first opening being provided in the intermediate wall.

8. The vending machine according to claim 7, wherein the intermediate wall and the first and second side walls collectively define a rear channel of the main body, said lock member being positioned in the channel.

9. The vending machine according to claim 8, wherein the lock member is loosely secured in the channel of the main body.

10. The vending machine according to claim 7, wherein the first opening takes the form of a slot.

11. The vending machine according to claim 7, wherein the intermediate wall of the main body includes a third opening and said lock member includes a fourth opening which is aligned with the third opening, said lock member being attached to the main body at the third and fourth openings.

12. The vending machine according to claim 11, wherein each of the second and fourth openings are internally threaded.

13. The vending machine according to claim 1, wherein the second end portion of the main body includes a mounting flange, said mounting flange being secured to said one of the plurality of column walls.

14. The vending machine according to claim 1, wherein the second end portion of the main body includes an extended tab member, said one of the plurality of column walls having a side surface including a slot, wherein the extended tab member extends into the slot to detachably secure the second end portion of the main body to the column wall.

15. A vending machine comprising:

a cabinet frame including top, bottom, side and rear walls that collectively define a central cavity;

a plurality of column walls defining various stack areas for receiving product containers to be dispensed from the vending machine;

a door pivotally connected to the cabinet frame, said door being selectively movable between an open condition, wherein access to the central cavity is permitted for loading of product containers into the various stack areas of the vending machine, and a closed condition, wherein dispensing of product containers is permitted;

a locking element attached to the door; and a lock assembly including a main body and a lock member, the main body having first and second side walls interconnected by an intermediate wall, each of the first and second side walls and the intermediate wall defining part of first and second end portions of the main body, with each of the first and second end portions being secured to a respective one of the cabinet frame and the plurality of column walls, said intermediate wall and said first and second side walls collectively defining a channel of the main body, said lock member being positioned in the channel and attached to the main body, wherein the locking element on the door engages the lock member to secure the door in the closed condition so as to prevent pilfering of the vending machine.

16. The vending machine according to claim 15, wherein the lock assembly further includes a support bracket interconnecting the first end portion of the main body to the cabinet frame.

17. The vending machine according to claim 16, wherein the support bracket is detachably secured to the cabinet frame through a plurality of mechanical fasteners.

18. The vending machine according to claim 16, wherein support bracket is integrally formed with the main body.

19. The vending machine according to claim 18, wherein the support bracket is formed with at least one slot and said main body includes at least one tab element which extends into the at least one slot to interlock the support bracket and the main body.

20. The vending machine according to claim 19, wherein the support bracket is formed with at least two slots and said main body includes at least two tab elements interlocking the main body with the support bracket through the at least two slots.

21. The vending machine according to claim 15, wherein the main body is generally U-shaped in cross-section.

22. The vending machine according to claim 15, wherein the lock member is loosely secured in the channel of the main body.

23. The vending machine according to claim 15, wherein said intermediate wall is provided with a first opening, said lock member being interconnected to the main body and including a second opening which is aligned with the first opening, said lock element being adapted to extend into each of the first and second openings.

24. The vending machine according to claim 23, wherein the first opening takes the form of a slot.

25. The vending machine according to claim 23, wherein the intermediate wall of the main body includes a third opening and said lock member includes a fourth opening which is aligned with the third opening, said lock member being attached to the main body at the third and fourth openings.

26. The vending machine according to claim 25, wherein each of the second and fourth openings are internally threaded.

27. The vending machine according to claim 15, wherein the second end portion of the main body includes a mounting flange, said mounting flange being secured to said one of the plurality of column walls.

28. The vending machine according to claim 15, wherein the second end portion of the main body includes an extended tab member, said one of the plurality of column walls having a side surface including a slot, wherein the extended tab member extends into the slot to detachably secure the second end portion of the main body to the column wall.

* * * * *